US010069253B2

(12) United States Patent
Zhang et al.

(10) Patent No.: US 10,069,253 B2
(45) Date of Patent: Sep. 4, 2018

(54) FILTER AND RADIO FREQUENCY COAXIAL CONNECTOR

(71) Applicant: HUAWEI TECHNOLOGIES CO., LTD., Shenzhen (CN)

(72) Inventors: Hui Zhang, Shenzhen (CN); Xiaoming Shi, Kista (SE); Lifang Dong, Shenzhen (CN); Shaopei Cheng, Chengdu (CN); Xiangqi Yu, Chengdu (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 0 days.

(21) Appl. No.: 15/854,807

(22) Filed: Dec. 27, 2017

(65) Prior Publication Data

US 2018/0123298 A1 May 3, 2018

Related U.S. Application Data

(63) Continuation of application No. PCT/CN2016/083014, filed on May 23, 2016.

(30) Foreign Application Priority Data

Jun. 30, 2015 (CN) ..... 2015 2 0460330 U

(51) Int. Cl.
*H01R 13/60* (2006.01)
*H01R 13/7197* (2011.01)
(Continued)

(52) U.S. Cl.
CPC ..... *H01R 13/7197* (2013.01); *H01P 1/20* (2013.01); *H01R 13/631* (2013.01); *H01R 13/74* (2013.01); *H01R 24/42* (2013.01); *H01R 2103/00* (2013.01)

(58) Field of Classification Search
CPC ..... H01R 13/518; H01R 13/145; H01R 23/7042; H01R 23/025; H01R 13/5202
See application file for complete search history.

(56) References Cited

U.S. PATENT DOCUMENTS 4,206,963 A 6/1980 English et al.
6,113,397 A 9/2000 Myers
(Continued)

FOREIGN PATENT DOCUMENTS

CN 1988285 A 6/2007
CN 201247878 Y 5/2009
(Continued)

*Primary Examiner* — Phuong Chi T Nguyen
(74) *Attorney, Agent, or Firm* — Kilpatrick Townsend & Stockton LLP

(57) ABSTRACT

The present disclosure provides a filter and a radio frequency coaxial connector, to implement fast blind-mate of various signal ports. The filter includes: a filter cavity body and a coaxial connection component. The coaxial connection component is embedded in the filter cavity body in a self-clinching manner. The coaxial connection component includes a socket outer conductor and a main rod. The main rod penetrates the socket outer conductor, and one end of the main rod is connected to a signal end disposed in the filter cavity body. The coaxial connection component is in socket joint with a radio frequency coaxial connector by using the socket outer conductor, and the coaxial connection component matches the radio frequency coaxial connector.

14 Claims, 4 Drawing Sheets

(51) Int. Cl.

| | |
|---|---|
| ***H01R 24/42*** | (2011.01) |
| ***H01R 13/631*** | (2006.01) |
| ***H01P 1/20*** | (2006.01) |
| ***H01R 13/74*** | (2006.01) |
| *H01R 103/00* | (2006.01) |

(56) References Cited

U.S. PATENT DOCUMENTS

| | | | | |
|---|---|---|---|---|
| 8,388,374 | B2 * | 3/2013 | Grek | H01R 13/622 439/578 |
| 8,388,377 | B2 * | 3/2013 | Zraik | H01R 13/622 439/578 |
| 8,961,224 | B2 * | 2/2015 | Grek | H01R 9/0503 439/578 |
| 8,998,640 | B1 * | 4/2015 | Mitchell, Jr. | H01R 13/6215 439/578 |
| 2017/0070003 | A1 | 3/2017 | An et al. | |

FOREIGN PATENT DOCUMENTS

| | | | |
|---|---|---|---|
| CN | 203481564 | U | 3/2014 |
| CN | 204067533 | U | 12/2014 |
| CN | 204349085 | U | 5/2015 |
| JP | 2012174654 | A | 9/2012 |

* cited by examiner

FILTER AND RADIO FREQUENCY COAXIAL CONNECTOR

CROSS-REFERENCE TO RELATED APPLICATIONS

This application is a continuation of International Application No. PCT/CN2016/083014, filed on May 23, 2016, which claims priority to Chinese Patent Application No. 201520460330.9, filed on Jun. 30, 2015, both of which are hereby incorporated by reference in their entireties.

TECHNICAL FIELD

The present disclosure relates to the field of communications device technologies, and specifically, to a filter and a radio frequency coaxial connector.

BACKGROUND

As an open architecture of a small cell is modularized, not only a baseband unit and a radio frequency unit are separately used as independent modules, but also a filter in the radio frequency unit is designed as an independent structure. A specific quantity of filters may be selected according to different frequency bands and freely combined. A configuration is relatively flexible.

As shown in FIG. 1, a currently provided filter and antenna feeder connector are integrated into one body. A through hole is disposed in a box body. The filter is installed inside the box body. The antenna feeder connector penetrates the box body through the through hole in the box body. Then the antenna feeder connector is fastened by using a hex nut in cooperation with a waterproof rubber pad and a locking washer. As shown in FIG. 1, the filter and the antenna feeder connector are integrated into one body, and a size of the through hole in the box body exactly matches the antenna feeder connector, to meet a requirement of waterproofing and high isolation. During installation, the antenna feeder connector is aligned with a position of the through hole, and the filter is pushed forward and installed inside the box body, so that the antenna feeder connector penetrates the through hole. In this installation manner, a transmit port and a receive port of the filter and a printed circuit board (PCB) installed at the bottom of the box body cannot implement blind-mate. In addition, because installation needs to be implemented by pushing the filter forward, more interior space of the box body is required. In addition, the hex nut fastening the antenna feeder connector tends to apply a counter force to the antenna feeder connector. Consequently, the nut becomes loose, grounding fails, and intermodulation is hindered.

SUMMARY

To overcome the foregoing disadvantages, the present disclosure provides a filter and a radio frequency coaxial connector that are separately designed, to implement fast blind-mate of various signal ports of the filter.

A first aspect of the present disclosure provides a filter, and the filter may include:

a filter cavity body and a coaxial connection component, where the coaxial connection component is embedded in the filter cavity body in a self-clinching manner, the coaxial connection component includes a socket outer conductor and a main rod, the main rod penetrates the socket outer conductor, one end of the main rod is connected to a signal end disposed in the filter cavity body, and the coaxial connection component is in socket joint with a radio frequency coaxial connector by using the socket outer conductor, where the coaxial connection component matches the radio frequency coaxial connector.

With reference to the first aspect, in a first possible implementation, the socket outer conductor includes a self-clinching convex mesa and a split groove structure, the coaxial connection component is embedded in the filter cavity body in a self-clinching manner by using the self-clinching convex mesa, a cavity is formed between the split groove structure and an inner surface of the filter cavity body, and the coaxial connection component is in socket joint with the radio frequency coaxial connector by using the split groove structure.

With reference to the first possible implementation of the first aspect, in a second possible implementation, the radio frequency coaxial connector includes a flange base, a sleeve outer conductor, and a coaxial signal interface, the sleeve outer conductor is disposed on one side of the flange base, a through hole is disposed in the flange base in a position corresponding to the sleeve outer conductor, the coaxial signal interface is disposed on the other side of the flange base in a position corresponding to the position of the through hole, a positioning slot is disposed on an outer surface of the sleeve outer conductor, and an elastic component is disposed inside the positioning slot; and the coaxial connection component is in socket joint with the sleeve outer conductor of the radio frequency coaxial connector by using the split groove structure, an inner surface of the sleeve outer conductor and an outer surface of the split groove structure are fitted to form a first shielding structure, the sleeve outer conductor fills the cavity between the split groove structure and the inner surface of the filter cavity body, the elastic component of the sleeve outer conductor and the inner surface of the filter cavity body are press-fitted to form a second shielding structure.

With reference to the first aspect, or the first or the second possible implementation of the first aspect, in a third possible implementation, a material of the socket outer conductor is an elastic material.

With reference to the third possible implementation of the first aspect, in a fourth possible implementation, one or more opening grooves are disposed on the split groove structure.

With reference to the fourth possible implementation of the first aspect, in a fifth possible implementation, the coaxial connection component further includes an insulation medium, and the insulation medium is closely pressed against the inner surface of the socket outer conductor.

With reference to the second possible implementation of the first aspect, in a sixth possible implementation, at least one circular hole is disposed on the inner surface of the filter cavity body, and when the coaxial connection component is in socket joint with the sleeve outer conductor of the radio frequency coaxial connector by using the split groove structure, the elastic component of the sleeve outer conductor and the circular hole are press-fitted.

With reference to the second or the sixth possible implementation of the first aspect, in a seventh possible implementation, the positioning slot is an annular positioning slot, and the elastic component disposed inside the positioning slot is an annular elastic component or a C-type elastic component.

A second aspect of the present disclosure provides a radio frequency coaxial connector, including:

a flange base, a sleeve outer conductor, and a coaxial signal interface, where the sleeve outer conductor is disposed on one side of the flange base, a through hole is disposed in the flange base in a position corresponding to the sleeve outer conductor, the coaxial signal interface is disposed on the other side of the flange base in a position corresponding to the position of the through hole, and the radio frequency coaxial connector is in socket joint with a coaxial connection component of a filter by using the sleeve outer conductor, where the radio frequency coaxial connector matches the coaxial connection component of the filter.

With reference to the second aspect, in a first possible implementation, a positioning slot is disposed on an outer surface of the sleeve outer conductor, and an elastic component is disposed inside the positioning slot.

With reference to the second aspect or the first possible implementation of the second aspect, in a second possible implementation, the filter includes a filter cavity body and a coaxial connection component, the coaxial connection component includes a socket outer conductor and a main rod, the main rod penetrates the socket outer conductor, and one end of the main rod is connected to a signal end disposed in the filter cavity body;

the socket outer conductor includes a self-clinching convex mesa and a split groove structure, the coaxial connection component is embedded in the filter cavity body in a self-clinching manner by using the self-clinching convex mesa, a cavity is formed between the split groove structure and an inner surface of the filter cavity body, and the coaxial connection component is in socket joint with the sleeve outer conductor of the radio frequency coaxial connector by using the split groove structure; and an inner surface of the sleeve outer conductor and an outer surface of the split groove structure are fitted to form a first shielding structure, the sleeve outer conductor fills the cavity between the split groove structure and the inner surface of the filter cavity body, and the elastic component of the sleeve outer conductor and the inner surface of the filter cavity body are press-fitted to form a second shielding structure.

With reference to the second possible implementation of the second aspect, in a third possible implementation, at least one circular hole is disposed on the inner surface of the filter cavity body, and when the coaxial connection component is in socket joint with the sleeve outer conductor by using the split groove structure, the elastic component of the sleeve outer conductor and the circular hole are press-fitted.

With reference to the second aspect, or the first, or the second, or the third possible implementation of the second aspect, in a fourth possible implementation, a circular sealing slot is further disposed on the flange base, and an elastic component is disposed in the circular sealing slot.

With reference to the second aspect, or the first, or the second, or the third possible implementation of the second aspect, in a fifth possible implementation, the radio frequency coaxial connector further includes an insulation medium, and the insulation medium is disposed inside the sleeve outer conductor.

With reference to the second aspect, or the first, or the second, or the third possible implementation of the second aspect, in a sixth possible implementation, a through hole is further disposed on the flange base.

With reference to the second possible implementation of the second aspect, in a seventh possible implementation, the positioning slot is an annular positioning slot, and the elastic component disposed inside the positioning slot is an annular elastic component or a C-type elastic component.

With reference to the second aspect, in an eighth possible implementation, the coaxial signal interface is an N-type interface or a DIN interface.

It may be learned that the filter provided in the present disclosure includes at least a filter cavity body and a coaxial connection component. The coaxial connection component is embedded in the filter cavity body in a self-clinching manner. The coaxial connection component includes at least a socket outer conductor and a main rod. The main rod penetrates the socket outer conductor, and one end of the main rod is connected to a signal end disposed in the filter cavity body, to transmit a signal. The coaxial connection component is in socket joint with a radio frequency coaxial connector by using the socket outer conductor, and the coaxial connection component matches the radio frequency coaxial connector. The coaxial connection component is embedded in the filter cavity body in a self-clinching manner, that is, the coaxial connection component does not protrude from the filter cavity body. Therefore, when the filter is assembled to a box body, a prior-art disadvantage of assembly by pushing the filter forward can be avoided, to implement fast blind-mate of various signal ports of the filter in different directions, and avoid complex cables inside the box body. After the filter is blindly mated with the box body, the coaxial connection component is in socket joint with the radio frequency coaxial connector by using the socket outer conductor, to implement signal transmission. In the present disclosure, a filter and a connector are completely separate, to implement fast blind-mate. In addition, the filter does not need to be assembled by means of side pushing, and therefore has a relatively low requirement for installation space of the box body, and module miniaturization is facilitated.

On the other hand, the radio frequency coaxial connector provided in the present disclosure includes a flange base, a sleeve outer conductor, and a coaxial signal interface. The sleeve outer conductor is disposed on one side of the flange base, and a through hole is disposed in the flange base in a position corresponding to the sleeve outer conductor. The coaxial signal interface is disposed on the other side of the flange base in a position corresponding to the position of the through hole. The radio frequency coaxial connector is in socket joint with the coaxial connection component of the filter by using the sleeve outer conductor, and the radio frequency coaxial connector matches the coaxial connection component of the filter. The radio frequency coaxial connector and the filter provided in the present disclosure are detachably connected, so that various signal ends of the filter implement fast blind-mate in different directions, a requirement for installation space of the box body is relatively low, and module miniaturization is facilitated.

BRIEF DESCRIPTION OF DRAWINGS

To describe the technical solutions in the present disclosure more clearly, the following briefly describes the accompanying drawings required for describing the present disclosure. Apparently, the accompanying drawings in the following description show merely some embodiments of the present disclosure, and persons of ordinary skill in the art may still derive other drawings from these accompanying drawings without creative efforts.

DESCRIPTION OF EMBODIMENTS

The following clearly describes the technical solutions in the present disclosure with reference to the accompanying drawings in the present disclosure. Apparently, the described embodiments are merely some but not all of the embodiments of the present disclosure. All other embodiments obtained by persons of ordinary skill in the art based on the embodiments of the present disclosure without creative efforts shall fall within the protection scope of the present disclosure.

The present disclosure provides a filter and a radio frequency coaxial connector that are separately designed, to implement fast blind-mate of various signal ports of the filter.

Figure 1:
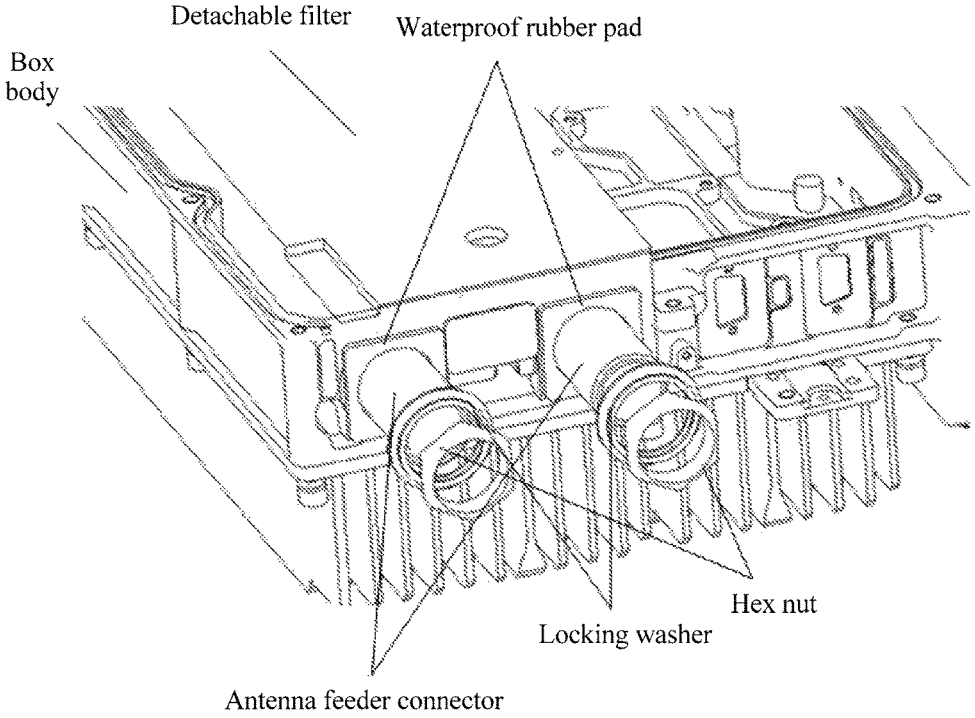
FIG. 1 is a schematic diagram of an application of a filter according to the prior art.
Figure 2:
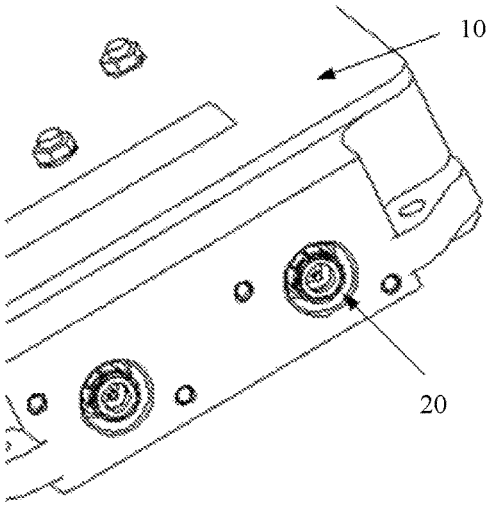
FIG. 2 is a schematic structural diagram of a filter according to an embodiment of the present disclosure.
Figure 3:
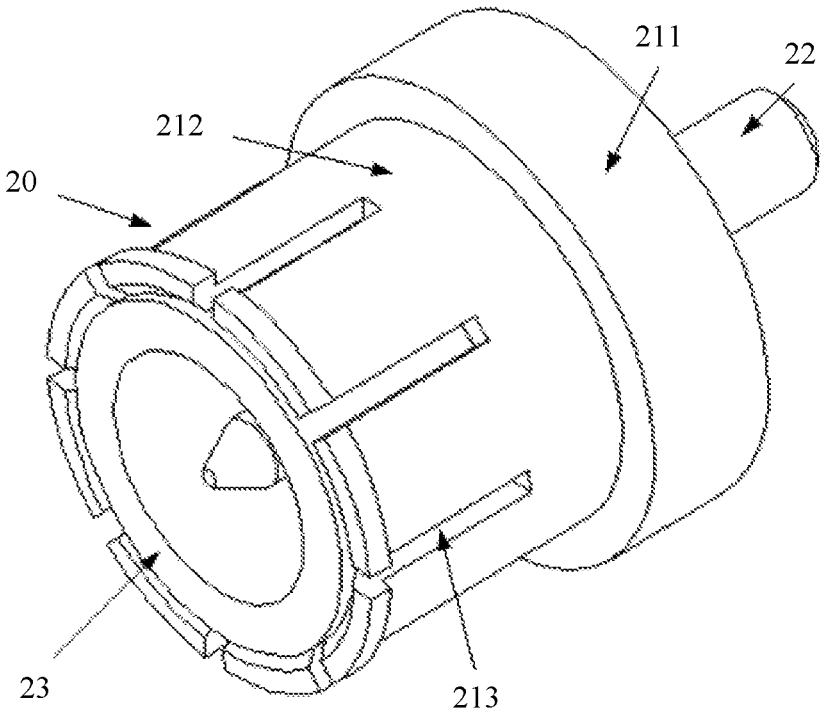
FIG. 3 is a schematic structural diagram of a coaxial connection component according to an embodiment of the present disclosure.
Figure 4:
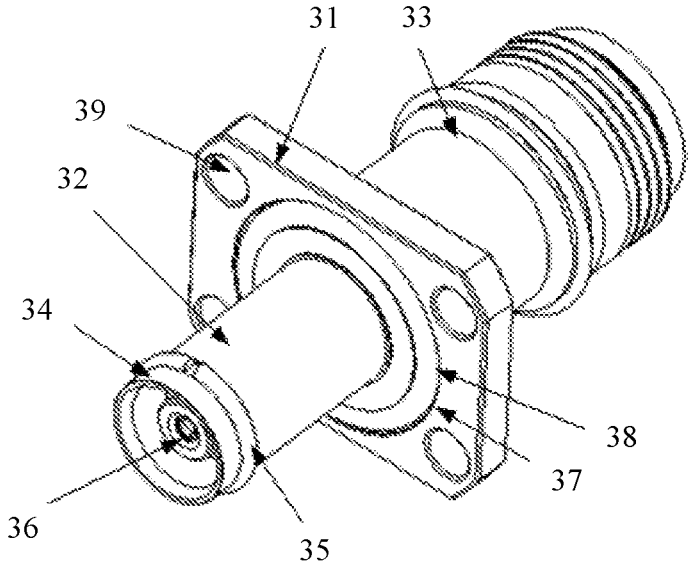
FIG. 4 is a schematic structural diagram of a radio frequency coaxial connector according to an embodiment of the present disclosure.

With reference to FIG. 2 to FIG. 4, the following separately describes in detail the filter and the radio frequency coaxial connector according to the present disclosure. FIG. 2 is a schematic structural diagram of a filter according to an embodiment of the present disclosure. FIG. 3 is a schematic structural diagram of a coaxial connection component according to an embodiment of the present disclosure. FIG. 4 is a schematic structural diagram of a radio frequency coaxial connector according to an embodiment of the present disclosure.

Specifically, with reference to FIG. 2 and FIG. 3, the following first describes the filter provided in the present disclosure. A filter may include:

a filter cavity body 10 and a coaxial connection component 20.

The coaxial connection component 20 is embedded in the filter cavity body 10 in a self-clinching manner. The coaxial connection component 20 includes a socket outer conductor and a main rod 22. The main rod 22 penetrates the socket outer conductor, and one end of the main rod 22 is connected to a signal end disposed in the filter cavity body 10. The coaxial connection component 20 is in socket joint with a radio frequency coaxial connector 30 by using the socket outer conductor, and the coaxial connection component matches the radio frequency coaxial connector.

It may be understood that when the socket outer conductor is in socket joint with the radio frequency coaxial connector 30, the socket outer conductor is specifically fitted in the radio frequency coaxial connector 30, so that the coaxial connection component 20 and the radio frequency coaxial connector 30 complete cooperation.

It may be learned that the filter in accordance with the present disclosure includes at least a filter cavity body 10 and a coaxial connection component 20. The coaxial connection component 20 is embedded in the filter cavity body 10 in a self-clinching manner. The coaxial connection component 20 includes at least a socket outer conductor and a main rod 22. The main rod 22 penetrates the socket outer conductor, and one end of the main rod 22 is connected to a signal end disposed in the filter cavity body 10, to transmit a signal. The coaxial connection component 20 is in socket joint with a radio frequency coaxial connector 30 by using the socket outer conductor, and the coaxial connection component matches the radio frequency coaxial. The coaxial connection component 20 is embedded in the filter cavity body 10 in a self-clinching manner, that is, the coaxial connection component 20 does not protrude from the filter cavity body 10. Therefore, when the filter is assembled to a box body, a prior-art disadvantage of assembly by pushing forward can be avoided, to implement fast blind-mate of various signal ports of the filter in different directions, and avoid complex cables inside the box body. After the filter is blindly mated with the box body, the coaxial connection component 20 is in socket joint with the radio frequency coaxial connector 30 by using the socket outer conductor, to implement signal transmission. In the present disclosure, a filter and a connector are completely separate, to implement fast blind-mate. In addition, the filter does not need to be assembled by means of side pushing, and therefore has a relatively low requirement for installation space of the box body, and module miniaturization is facilitated.

Specifically, referring to FIG. 3, the socket outer conductor includes a self-clinching convex mesa 211 and a split groove structure 212. The coaxial connection component 20 is embedded in the filter cavity body 10 in a self-clinching manner by using the self-clinching convex mesa 211 (FIG. 2 shows a state obtained after self-clinching). A cavity is formed between the split groove structure 212 and an inner surface of the filter cavity body 10. The coaxial connection component 20 is in socket joint with the radio frequency coaxial connector 30 by using the split groove structure 212.

It may be understood that the socket outer conductor of the coaxial connection component 20 includes a self-clinching convex mesa 211 and a split groove structure 212, and the coaxial connection component 20 is embedded in the filter cavity body 10 in a self-clinching manner by using the self-clinching convex mesa 211. When the self-clinching convex mesa 211 is compared with the split groove structure 212, the self-clinching convex mesa 211 is in the deep of the filter cavity body 10, and one end of the main rod 22 penetrates the self-clinching convex mesa 211 and is connected to a signal end of the filter cavity body 10. The split groove structure 212 faces the external of the filter cavity body 10, and an opening of the split groove structure 212 is flush with an edge of the filter cavity body 10 or is below an edge of the filter cavity body 10 (as shown in FIG. 2). The other end of the main rod 22 penetrates the split groove structure 212, but does not protrude from the filter cavity body 10. When the coaxial connection component 20 is embedded in the filter cavity body 10 in a self-clinching manner by using the self-clinching convex mesa 211, a cavity is formed between the split groove structure 212 and an inner surface of the filter cavity body 10 (as shown in FIG. 2).

In a specific application, a tail end of the main rod 22 on the side of the split groove structure 212 may be a needle-tip type. In addition, when the coaxial connection component 20 is in socket joint with the radio frequency coaxial connector 30 by using the split groove structure 212, the main rod 22 is plugged into the radio frequency coaxial connector 30, to transmit a signal.

The radio frequency coaxial connector 30 is subsequently described in detail, and details are not described herein.

Further, the coaxial connection component 20 further includes an insulation medium 23, and the insulation medium 23 is closely pressed against an inner surface of the socket outer conductor. The insulation medium 23 is configured to implement mutual insulation between the main rod 22 and the outside.

Further, the socket outer conductor is an elastic conductor made of an elastic material. Materials of the self-clinching convex mesa 211 and the split groove structure 212 are the same, and are also elastic materials. The self-clinching convex mesa 211 and the split groove structure 212 are both elastic.

It may be understood that it is easier for an elastic socket outer conductor to be in socket joint with the radio frequency coaxial connector 30. The socket outer conductor under pressure can rebound to fit more closely and does not come loose easily, so as to implement sealing and angle tolerance.

Further, one or more opening grooves 213 are further disposed on the split groove structure 212. It may be understood that opening grooves are disposed on the split groove structure 212 at an interval of a specific distance. Because the split groove structure 212 is an elastic material, the statically-placed split groove structure 212 is in a petal shape. Similarly, when the split groove structure 212 is fitted in the radio frequency coaxial connector 30, the split groove structure 212 with opening grooves is easier to install. The split groove structure 212 under pressure can rebound to fit more closely and does not come loose easily, so as to implement sealing.

Further, at least one circular hole is disposed on the inner surface of the filter cavity body 10. A function of the circular hole is described subsequently, and details are not described herein.

Specifically, with reference to FIG. 4, a radio frequency coaxial connector 30 in accordance with the present disclosure is described in detail. The radio frequency coaxial connector 30 in accordance with the present disclosure and the foregoing filter are used as a set, and the radio frequency coaxial connector 30 is configured to implement socket joint with the coaxial connection component 20 of the foregoing filter. The radio frequency coaxial connector 30 may include:

a flange base 31, a sleeve outer conductor 32, and a coaxial signal interface 33.

The sleeve outer conductor 32 is disposed on one side of the flange base 31. A through hole is disposed in the flange base 31 in a position corresponding to the sleeve outer conductor 32. The coaxial signal interface 33 is disposed on the other side of the flange base 31 in a position corresponding to the position of the through hole. The radio frequency coaxial connector 30 is in socket joint with a coaxial connection component 20 of a filter by using the sleeve outer conductor 32, and the radio frequency coaxial connector 30 matches the coaxial connection component 20 of the filter.

An opening aperture of a cavity of the sleeve outer conductor 32 is a diameter of the through hole. Similarly, a diameter of the coaxial signal interface 33 is the diameter of the through hole. Therefore, the sleeve outer conductor 32 and the coaxial signal interface 33 are coaxially structured. The cavity of the sleeve outer conductor 32, the through hole in the flange base 31, and the coaxial signal interface 33 form a signal transmission channel.

It may be learned that the radio frequency coaxial connector 30 in accordance with one embodiment the present disclosure includes a flange base 31, a sleeve outer conductor 32, and a coaxial signal interface 33. The sleeve outer conductor 32 is disposed on one side of the flange base 31. A through hole is disposed in the flange base 31 in a position corresponding to the sleeve outer conductor 32. The coaxial signal interface 33 is disposed on the other side of the flange base 31 in a position corresponding to the position of the through hole. The radio frequency coaxial connector 30 is in socket joint with a coaxial connection component 20 of a filter by using the sleeve outer conductor 32, and the radio frequency coaxial connector 30 matches the coaxial connection component 20 of the filter. The radio frequency coaxial connector 30 and the filter in accordance with the present disclosure are detachably connected, so that various signal ends of the filter implement fast blind-mate in different directions, a requirement for installation space of a box body is relatively low, and module miniaturization is facilitated.

The coaxial signal interface 33 is an N-type interface, a DIN interface, or the like. For example, the N-type interface is specifically a standard N-type female interface. It may be understood that alternatively, the coaxial signal interface may be another common standard interface in the field, and this is not limited herein.

Specifically, referring to FIG. 4, a positioning slot 34 is disposed on an outer surface of the sleeve outer conductor 32, and an elastic component 35 is disposed inside the positioning slot 34.

In some embodiments, the positioning slot 34 is an annular positioning slot, and the elastic component 35 disposed inside the positioning slot 34 is an annular elastic component or a C-type elastic component. Specifically, the annular elastic component is a spring ring, and the C-type elastic component is a C-type spring ring.

Further, the radio frequency coaxial connector 30 further includes an insulation medium 36. The insulation medium 36 is disposed inside the sleeve outer conductor 32. A shape of insulation medium 36 is similar to that of the sleeve outer conductor 32, and is a cylinder with two open ends.

Further, a circular sealing slot 37 is further disposed on the flange base 31, and an elastic component 38 is disposed in the circular sealing slot 37.

Further, a through hole 39 is further disposed on the flange base 31. A function of the through hole 39 is described in detail subsequently, and details are not described herein.

In some implementations, the filter includes a filter cavity body 10 and a coaxial connection component 20. The coaxial connection component 20 includes a socket outer conductor and a main rod 22. A radio frequency coaxial connector 30 includes a flange base 31, a sleeve outer conductor 32, and a coaxial signal interface 33, and the radio frequency coaxial connector 30 matches the coaxial connection component 20. During assembly, the socket outer conductor is fitted in the sleeve outer conductor 32 to complete socket joint. Therefore, when the filter is assembled to a box body, a prior-art problem that blind-mate cannot be performed due to side pushing can be avoided. When the filter is assembled in the present disclosure, fast blind-mate is implemented.

Figure 5:
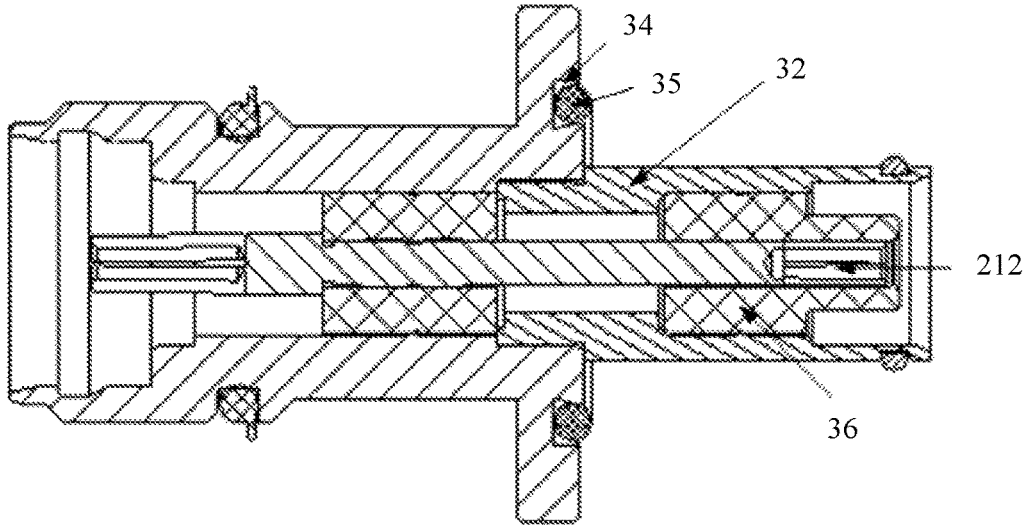
FIG. 5 is a cross sectional view of a radio frequency coaxial connector and a coaxial connection component that are in socket joint according to an embodiment of the present disclosure.
Figure 6:
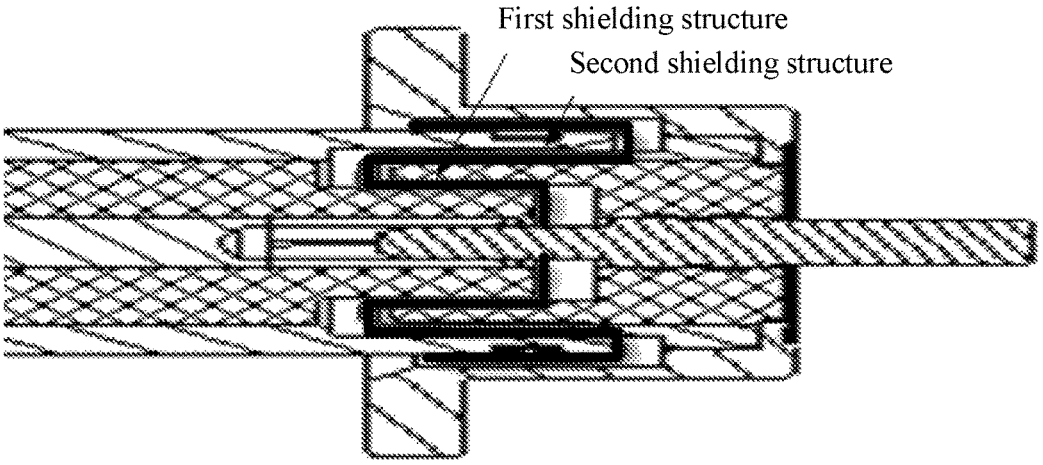
FIG. 6 is a cross sectional view of a radio frequency coaxial connector and a coaxial connection component that are in socket joint according to another embodiment of the present disclosure.

For yet some other implementations, refer FIG. 5 and FIG. 6. FIG. 5 is a cross sectional view of a radio frequency coaxial connector and a coaxial connection component that are in socket joint according to an embodiment of the present disclosure. FIG. 6 is a cross sectional view of a radio frequency coaxial connector and a coaxial connection component that are in socket joint according to another embodiment of the present disclosure. As shown in FIG. 5, the radio frequency coaxial connector 30 is in socket joint with the coaxial connection component 20 of the filter. Specifically, the coaxial connection component 20 is in socket joint with the sleeve outer conductor 32 of the radio frequency coaxial connector 30 by using the split groove structure 212. The sleeve outer conductor 32 fills the cavity between the split groove structure 212 and the filter cavity body 10. The main rod 22 penetrates the sleeve outer conductor 32, and is insulated by the insulation medium 36. When the split groove structure 212 is fitted in the sleeve outer conductor 32, because the split groove structure 212 is elastic and multiple opening grooves are disposed on the split groove structure 212, an outer surface of the split groove structure 212 and an inner surface of the sleeve outer conductor 32 can be closely fitted to form a first shielding structure (as shown in FIG. 6). The elastic component 35 of the sleeve outer conductor 32 and the inner surface of the filter cavity body 10 are press-fitted to form a second shielding structure (as shown in FIG. 6). Therefore, a double shielding structure is implemented. The double shielding structure forms a maze structure (as shown in a bold line in FIG. 6), so as to shield a signal in a more reliable manner, and meet a requirement for high isolation.

It may be understood that in the present disclosure, the elastic component 35 is positioned in the positioning slot 34, and the elastic component 35 may be a C-type elastic component. Therefore, a compression rate of the elastic component 35 may be adjusted by using a size of a C-type opening.

Further, both the sleeve outer conductor 32 and the elastic component 35 are of circular structures. The elastic component 35 may be a C-type elastic component. The sleeve outer conductor 32 and the elastic component 35 may cooperate in a radial direction, and are not affected by tightening torque of a screw or a change in torque released in a long-term application. Intermodulation is stable, and the double shielding structure obtained after cooperation forms a maze structure, so as to shield a signal in a more reliable manner, and meet a requirement for high isolation.

The split groove structure 212 is fitted in the sleeve outer conductor 32, and the main rod 22 penetrates the sleeve outer conductor 32, to further form an interconnection to the coaxial signal interface 33, and complete signal transmission.

Figure 7:
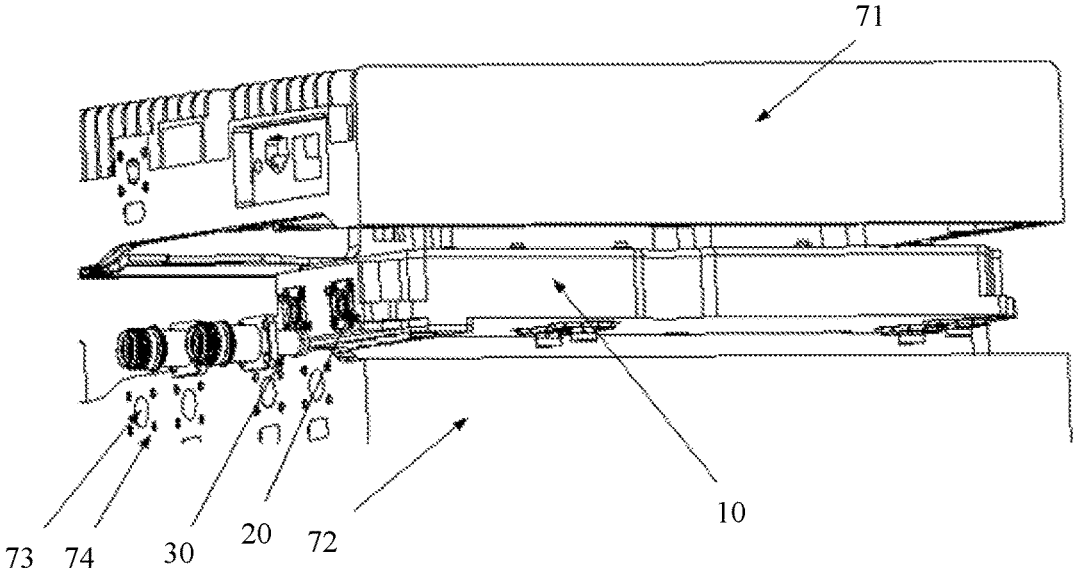
FIG. 7 is a schematic diagram of assembly of a filter according to an embodiment of the present disclosure.

Referring to FIG. 7, FIG. 7 is a schematic diagram of assembly of a filter according to an embodiment of the present disclosure. As shown in FIG. 7, a box body applicable to assemble the filter provided in the present disclosure includes an upper box body 71 and a lower box body 72. A through hole 73 is disposed in the lower box body 72 in a position corresponding to a coaxial connection component 20, and a threaded hole 74 is further disposed around the through hole 73. A radio frequency coaxial connector 30 penetrates the through hole 73 in the lower box body 72 and is in socket joint with the coaxial connection component 20 of the filter. The threaded hole 74 cooperates with a through hole 39 in a flange base 31, and the radio frequency connector 30 is fastened to the lower box body 72 by using a screw.

Four or more threaded holes 74 may be disposed around the through hole 73 in the lower box body 72. When there are four threaded holes 74, the four threaded holes 74 exactly form four vertexes of a square or a rectangle. Correspondingly, four through holes 39 are also disposed in corresponding positions of the flange base 31. Therefore, the radio frequency coaxial connector 30 and the lower box body 72 may become more stable, and functions of waterproofing and shielding are improved In addition, the threaded hole 74 in the lower box body 72 is not a through hole, and this further implements waterproofing and high isolation.

It should be noted that various signal ports such as a transmit port or a receive port are on a side, of the filter cavity body 10, facing the lower box body 72. A PCB is further disposed on a bottom of the lower box body 72, and various signal terminals are on the PCB.

According to the foregoing descriptions, when the filter is assembled, the filter may implement fast blind-mate into the lower box body 72. Specifically, fast blind-mate of various signal ports on the filter cavity body 10 into corresponding signal terminals on the PCB is implemented, and fast blind-mate between the coaxial connection component 20 and the radio frequency coaxial connector 30 penetrating the lower box body 72 is also implemented.

Figure 8:
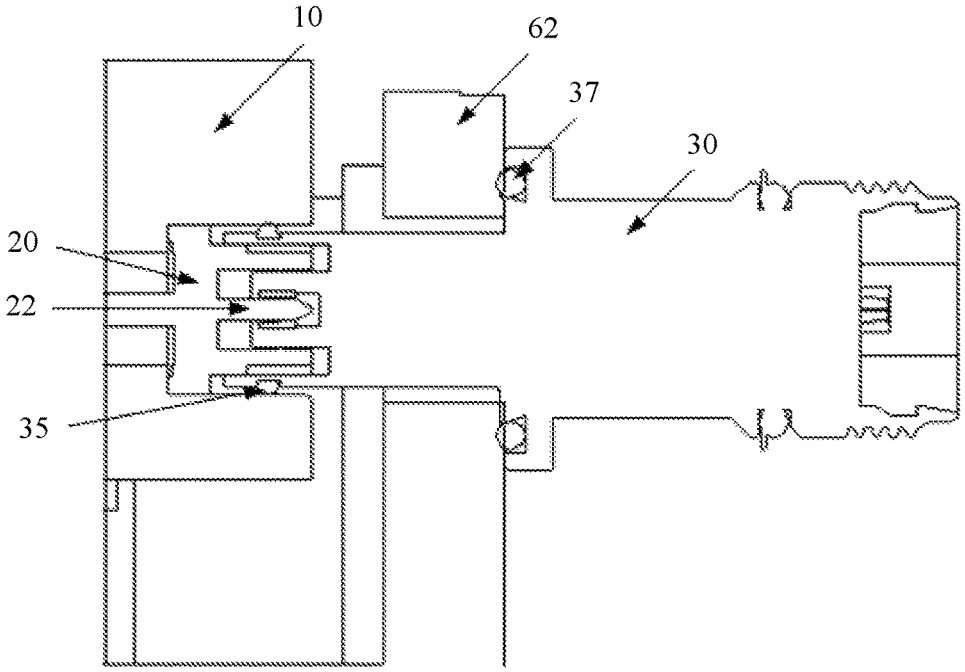
FIG. 8 is a cross sectional view of a structure of an assembled filter according to an embodiment of the present disclosure.

Referring to FIG. 8, FIG. 8 is a cross sectional view of a structure of an assembled filter according to an embodiment of the present disclosure. FIG. 8 is a cross sectional view of completed assembly of a box body, a filter, and a radio frequency coaxial connector. A radio frequency coaxial connector 30 penetrates a through hole 73 in a lower box body 72, and completes socket joint with a coaxial connection component 20 of the filter. Then the radio frequency coaxial connector 30 is fastened to the lower box body 72 by using a nut in cooperation with a through hole 39 in a flange base 31 and a threaded hole 74 in the lower box body 72.

In the foregoing embodiments, the description of each embodiment has respective focuses. For a part that is not described in detail in an embodiment, refer to related descriptions in other embodiments.

The foregoing describes in detail the filter and the radio frequency coaxial connector provided in the present disclosure, and ordinary persons skilled in the art can make variations to specific implementations and the application scope based on the ideas of the present disclosure. In conclusion, the content of this specification should not be understood as a limitation on the present disclosure.

What is claimed is:

1. A filter, comprising:

a filter cavity body 110 and a coaxial connection component 20, wherein the coaxial connection component is embedded in the filter cavity body 10 in a self-clinching manner, and the coaxial connection component comprises:

a socket outer conductor and a main rod 22, wherein the main rod 22 penetrates the socket outer conductor, and one end of the main rod is connected to a signal end disposed in the filter cavity body; and, wherein the coaxial connection component is in socket joint with a radio frequency coaxial connector by using the socket outer conductor, wherein the coaxial connection component matches the radio frequency coaxial connector;

wherein the socket outer conductor comprises a self-clinching convex mesa and a split groove structure, and wherein the coaxial connection component is embedded in the filter cavity body in a self-clinching manner by using the self-clinching convex mesa, a cavity is formed between the split groove structure and an inner surface of the filter cavity body, and the coaxial connection component is in socket joint with the radio frequency coaxial connector by using the split groove structure;

wherein the radio frequency coaxial connector comprises a flange base, a sleeve outer conductor, and a coaxial signal interface, wherein the sleeve outer conductor is disposed on one side of the flange base, a through hole is disposed in the flange base in a position corresponding to the sleeve outer conductor, the coaxial signal interface is disposed on the other side of the flange base in a position corresponding to the position of the through hole, a positioning slot is disposed on an outer surface of the sleeve outer conductor, and an elastic component is disposed inside the positioning slot; and, wherein the coaxial connection component is in socket joint with the sleeve outer conductor of the radio frequency coaxial connector by using the split groove structure, an inner surface of the sleeve outer conductor and an outer surface of the split groove structure are fitted to form a first shielding structure, the sleeve outer conductor fills the cavity between the split groove structure and the inner surface of the filter cavity body, the elastic component of the sleeve outer conductor and the inner surface of the filter cavity body are press-fitted to form a second shielding structure.

2. The filter according to claim 1, wherein the socket outer conductor is made of an elastic material.

3. The filter according to claim 1, wherein at least one circular hole is disposed on the inner surface of the filter cavity body, and when the coaxial connection component is in socket joint with the sleeve outer conductor of the radio frequency coaxial connector by using the split groove structure, the elastic component of the sleeve outer conductor and the circular hole are press-fitted.

4. The filter according to claim 1, wherein the positioning slot is an annular positioning slot, and the elastic component disposed inside the positioning slot is an annular elastic component or a C-type elastic component.

5. The filter according to claim 1, wherein one or more opening grooves are disposed on the split groove structure.

6. The filter according to claim 5, wherein the coaxial connection component further comprises an insulation medium, and the insulation medium is closely pressed against the inner surface of the socket outer conductor.

7. A radio frequency coaxial connector, comprising a flange base, a sleeve outer conductor, and a coaxial signal interface, wherein the sleeve outer conductor is disposed on one side of the flange base, a through hole is disposed in the flange base in a position corresponding to the sleeve outer conductor, the coaxial signal interface is disposed on the other side of the flange base in a position corresponding to the position of the through hole, and the radio frequency coaxial connector is in socket joint with a coaxial connection component of a filter by using the sleeve outer conductor, wherein the radio frequency coaxial connector matches the coaxial connection component of the filter;

wherein the filter comprises a filter cavity body and a coaxial connection component, wherein the coaxial connection component comprises a socket outer conductor and a main rod, the main rod penetrating the socket outer conductor, and one end of the main rod being connected to a signal end disposed in the filter cavity body;

the socket outer conductor comprises a self-clinching convex mesa and a split groove structure, wherein the coaxial connection component is embedded in the filter cavity body in a self-clinching manner by using the self-clinching convex mesa, a cavity being formed between the split groove structure and an inner surface of the filter cavity body, and the coaxial connection component is in socket joint with the sleeve outer conductor of the radio frequency coaxial connector by using the split groove structure; and an inner surface of the sleeve outer conductor and an outer surface of the split groove structure are fitted to form a first shielding structure, wherein the sleeve outer conductor fills the cavity between the split groove structure and the inner surface of the filter cavity body, and an elastic component of the sleeve outer conductor and the inner surface of the filter cavity body are press-fitted to form a second shielding structure.

8. The radio frequency coaxial connector according to claim 7, wherein at least one circular hole is disposed on the inner surface of the filter cavity body, and when the coaxial connection component is in socket joint with the sleeve outer conductor by using the split groove structure, the elastic component of the sleeve outer conductor and the circular hole are press-fitted.

9. The radio frequency coaxial connector according to claim 7, wherein a circular sealing slot is further disposed on the flange base, and an elastic component is disposed in the circular sealing slot.

10. The radio frequency coaxial connector according to claim 7, wherein the radio frequency coaxial connector further comprises an insulation medium, and the insulation medium is disposed inside the sleeve outer conductor.

11. The radio frequency coaxial connector according to claim 7, wherein a through hole is further disposed on the flange base.

12. The radio frequency coaxial connector according to claim 7, wherein the coaxial signal interface is an N-type interface or a DIN interface.

13. The radio frequency coaxial connector according to claim 7, comprising a positioning slot is disposed on an outer surface of the sleeve outer conductor, and an elastic component is disposed inside the positioning slot.

14. The radio frequency coaxial connector according to claim 13, wherein the positioning slot is an annular positioning slot, and the elastic component disposed inside the positioning slot is an annular elastic component or a C-type elastic component.

* * * * *